United States Patent [19]

Reichgut

[11] 4,086,906

[45] May 2, 1978

[54] FIREPLACE SHIELD

[76] Inventor: Martin Reichgut, 33 Highland Rd., Westport, Conn. 06880

[21] Appl. No.: 680,698

[22] Filed: Apr. 27, 1976

[51] Int. Cl.[2] ..... F23M 7/00

[52] U.S. Cl. ..... 126/140; 126/202

[58] Field of Search ..... 126/138, 140, 202; 160/DIG. 9, 84 R

[56] References Cited

U.S. PATENT DOCUMENTS

| | | | |
|---|---|---|---|
| 2,707,946 | 5/1955 | Merryweather | 126/202 |
| 3,375,818 | 4/1968 | Luther | 160/84 R |
| 3,777,800 | 12/1973 | Susoev | 160/84 R |
| 3,830,219 | 8/1974 | Gibbs | 126/202 |

FOREIGN PATENT DOCUMENTS

| | | | |
|---|---|---|---|
| 391,263 | 4/1933 | United Kingdom | 126/202 |

*Primary Examiner*—John J. Camby
*Assistant Examiner*—Larry I. Schwartz
*Attorney, Agent, or Firm*—Sherman Levy

[57] ABSTRACT

A fireplace shield or screen is provided that includes a movable member made of a suitable material such as asbestos fiber material that is flame resistant. The fabric shield can be mounted by frame pieces in proper position relative to the fireplace opening.

The fireplace shield of the present invention will seal the fireplace opening, act as a fireproof curtain, and resist air pressure differential forces.

3 Claims, 13 Drawing Figures

Fig-11
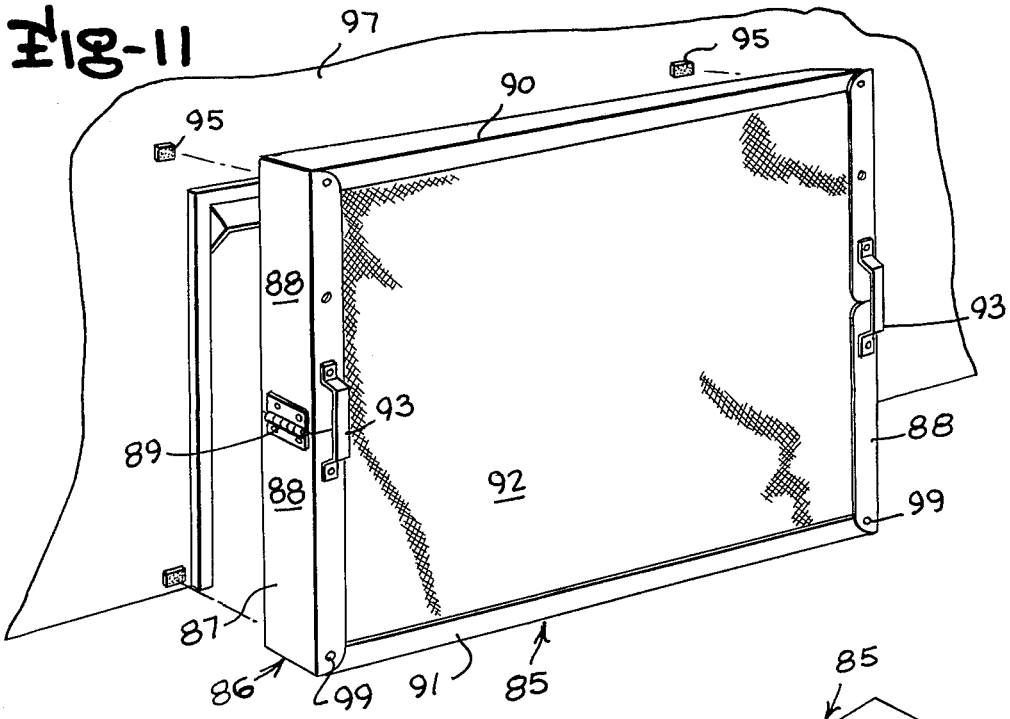
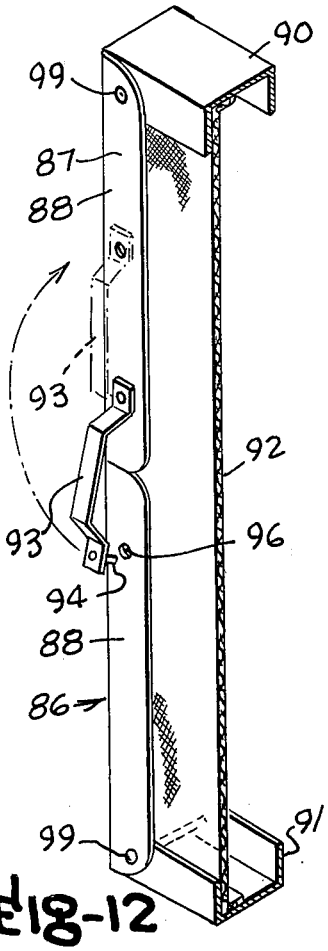
Fig-12
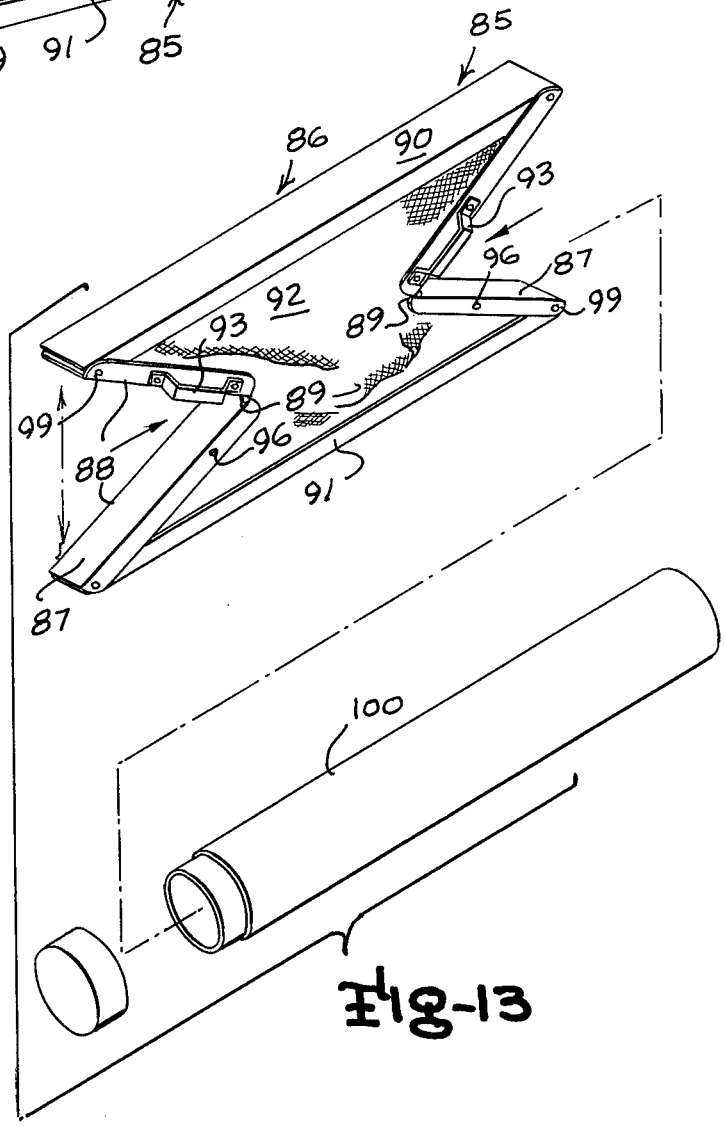
Fig-13

FIREPLACE SHIELD

BACKGROUND OF THE INVENTION

1. Field of the Invention

The present invention relates to an adjustable fireplace screen or shield wherein the shield functions as an energy saver by minimizing the draft or air flow at the fireplace opening once the fire has gone out so as to permit the flu to remain open while the embers are dying. This arrangement permits the effective use of the fireplace to heat the residence without encountering excessive heat loss and additional burden on the residence furnace as is presently experienced as room heat is drawn up the chimney.

In addition, the fireplace screen or shield of the present invention features universal mounting capability since the home owner or installer does not need any complex tools. Further no holes are required in the fireplace masonry, inasmuch as the unique construction of the frame permits the user to custom cut the frame to fit and then use compression fittings to provide or achieve a secure installation.

A frame is mounted in the fireplace opening by compression fittings. A fire resistant shield is provided that can be lowered within the frame in order to completely occlude the fireplace opening.

2. Summary of the Invention

A fireplace screen or shield is provided that in one form of the invention includes a folding fireplace curtain or shield that can be conveniently raised by manual pressure, or, when desired, the shield can be permitted to hang down in closed position. In another form of the invention, a roller type construction or mounting is provided for an asbestos fiber curtain whereby the fireplace opening can be selectively opened or closed as desired or required.

The present invention also includes a removable model.

There is further provided other important features such as a means for preventing the fabric shield from being drawn inward so as to minimize the air space opening at the side walls. A suitable face plate can be added to complete the installation, and certain of the parts can be utilized to form a rigid frame inside the fireplace.

The present invention relates to an adjustable fireplace screen or shield wherein the shield's primary function is an energy saver and wherein it minimizes the loss of warm air from a room after the fire has died down. This is the time when the fire no longer heats the room and the flu must remain open. This arrangement permits the effective use of the fireplace to heat the residence without encountering excessive heat loss, an additional burden on the residence furnace, as is presently experienced as room heat is drawn up the chimney.

A secondary function of this shield is as a safety device for homes, commercial businesses such as restaurants, ski lodges, clubs and the like, where the shield can be used to control a runaway fire or to prevent downdrafts from blowing glowing embers out into a room. While shields and screens for fireplaces have previously been provided, none of the prior devices has a perimeter frame to close off air leaks, or a brace reinforced shield to resist the stress of air pressure differential between the room interior and the outside. The present invention also is directed to a portable folding fireplace shield which embodies the same functional features in a low cost removable version.

The primary object of the present invention is to provide a fireplace screen or shield that functions as an energy saver by minimizing the draft at the fireplace opening after the fire has gone out. At this time the flu must remain open while the embers are dying and large amounts of room heat would ordinarily be lost up the chimney.

Still another object of the present invention is to provide an adjustable fireplace screen that is ruggedly constructed and efficient to use and which is relatively simple and inexpensive to manufacture and install.

Another object of the present invention is to provide a fireplace screen or shield that has improved characteristics and advantages as compared to previous fireplace screens.

Other objects and advantages of the present invention will become apparent in the following specification when considered in the light of the attached drawings.

BRIEF DESCRIPTION OF THE DRAWINGS

FIG. 11 is a perspective view of a portable folding fire shield and showing the position of the unit in front of a fireplace.

FIG. 12 is a partial sectional view showing a portion of the frame and the handle with the latch thereon.

FIG. 13 is a perspective view showing the unit of FIGS. 11 and 12 in partially folded position and illustrating the carrier tube.

DESCRIPTION OF THE PREFERRED EMBODIMENT

Figures 1, 2, 3, 4, 5:
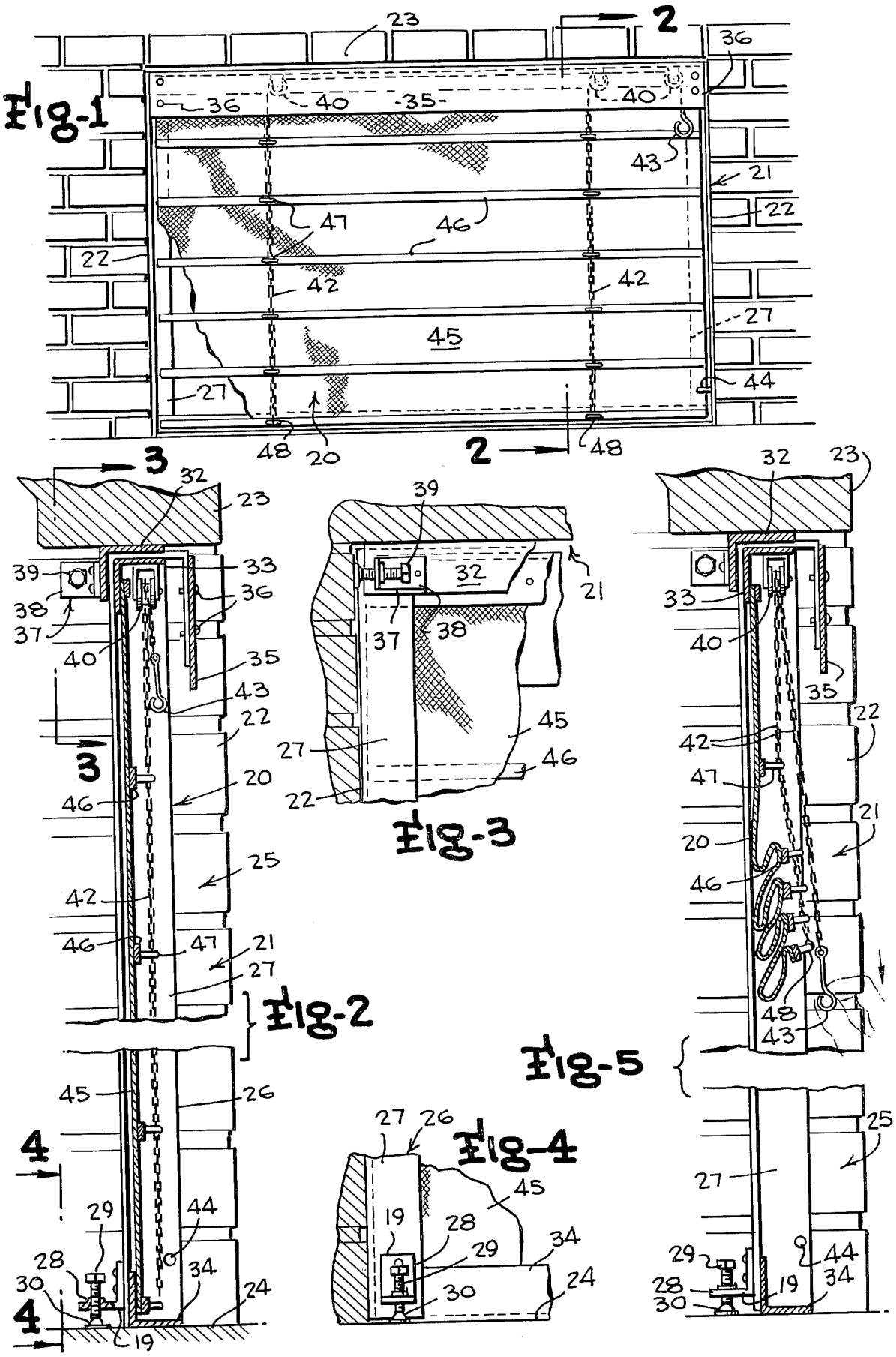
FIG. 1 is a front elevational view of the folding fireplace shield, and showing the shield in closed position, and with parts broken away for clarity of illustration.
FIG. 2 is a sectional view taken on the line 2—2 of FIG. 1.
FIG. 3 is a sectional view taken on the line 3—3 of FIG. 2.
FIG. 4 is a sectional view taken on the line 4—4 of FIG. 2.
FIG. 5 is a view generally similar to FIG. 2 but showing the shield or screen in raised position partially elevated.
Figure 6:
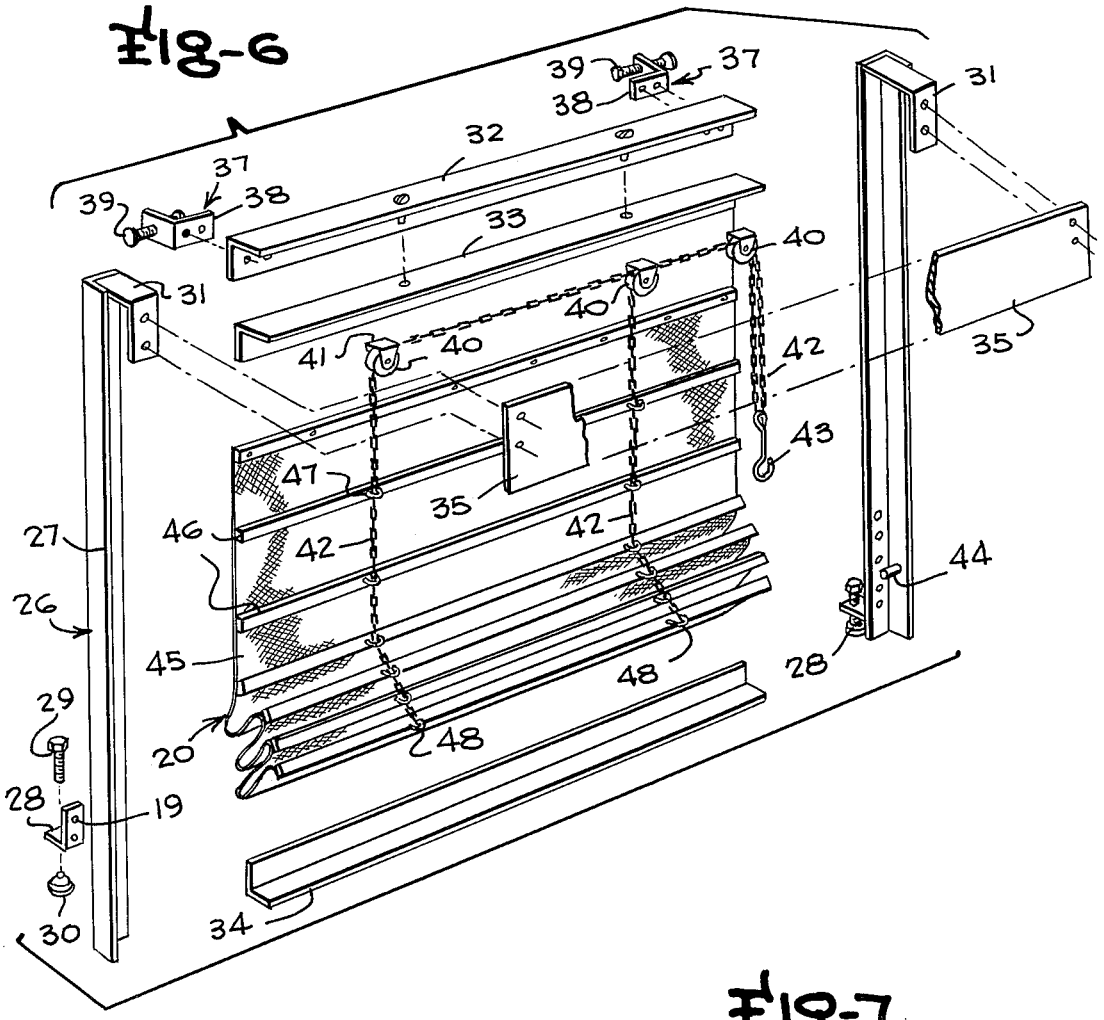
FIG. 6 is an exploded perspective view of the device of FIGS. 1 through 5.

Referring in detail to the drawings, and more particularly to FIGS. 1 through 6 of the drawings, the numeral 20 indicates the fireplace shield or screen of the present invention that is adapted to be mounted in a conventional fireplace that is indicated by the numeral 21, FIG. 1, and the fireplace 21 is defined by confronting side walls 22 as well as a top wall 23 and a base portion 24. The numeral 25 indicates the fireplace opening, FIG. 2. There is provided a frame that is indicated generally by the numeral 26, and the frame 26 includes a pair of spaced parallel vertically disposed side angles 27 that are mounted within the side walls 22. Lower compression fittings 28 are connected to the lower ends of the side angles 27, and each of the fittings 28 includes an L-shaped bracket 19 that is threaded and has a screw member 29 extended therethrough, and a fastener 30 is threadedly connected to the end of the screw member 29.

L-shaped brackets or top pieces 31 are connected to or formed integral with the upper ends of the side angles 27. The numeral 32 indicates a horizontally disposed top angle that extends between the upper ends of the side angles 27 and is secured thereto. A horizontally disposed shield support angle 33 is mounted below the top angle 32 and is secured in place as shown in the drawings. There is further provided a horizontally disposed bottom angle 34 that extends between the lower ends of the side angles 27 and is secured thereto. A horizontally disposed face plate 35 extends between the top sections 31 and is secured thereto by securing elements 36. There is further provided upper compression fittings 37 that each include L-shaped brackets 38 that have screw members 39 arranged in engagement therewith.

A plurality of rollers 40 are suitably mounted in place by means of brackets 41, and chains 42 are trained over the rollers 40, and a finger piece 43 is connected to the chains 42. A keeper 44 is affixed to the lower portion of one of the side angles 27 for selective engagement by the hook or finger piece 43.

There is further provided a foldable asbestos fiber fireplace shield or curtain 45 that has a plurality of horizontally disposed spaced parallel steel reinforcing rods 46 connected thereto, and guide member 47 are connected to the rods 46 for the projection therethrough of portions of the chains 42. The lower ends of the chains 42 are secured to the lower portion of the screen 45 as at 48, FIG. 6.

Referring now to FIGS. 7 through 10 of the drawings, there is illustrated a modified or alternative fireplace screen that is indicated generally by the numeral 49. The screen 49 is adapted to be used with a fireplace of a type that includes a top portion 50 as well as side portions 51 and a base portion 52. As shown in the drawings, the fireplace screen 49 includes a pair of vertically disposed side members 53 that have widened top portions 54 thereon, and a case 55 extends between the top portions 54 and is suitably secured thereto. The case 55 includes a top section 56 as well as a back section 57, and the top section 56 is recessed as at 58 whereby suitable securing elements or fasteners 59 can be extended through openings in the top section 56 and into engagement with corresponding openings or apertures in L-shaped roll mounting plates 60.

Figure 10:
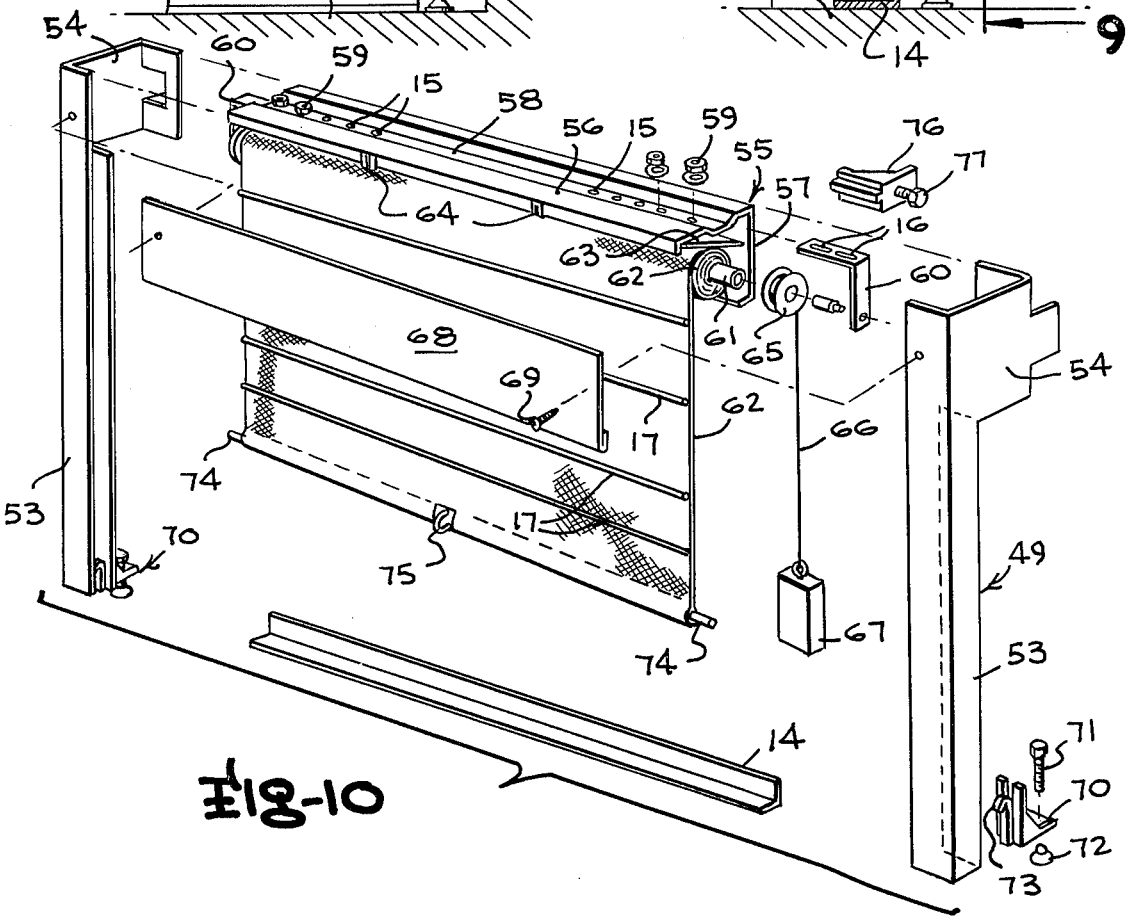
FIG. 10 is an enlarged exploded perspective view of the device of FIGS. 7 through 9.

The top section 56 of the case 55 has a plurality of pre-punched spaced holes, as indicated by the numeral 15 in FIG. 10. The mounting plates 60 have spaced apart slots 16 therein.

Figure 9:
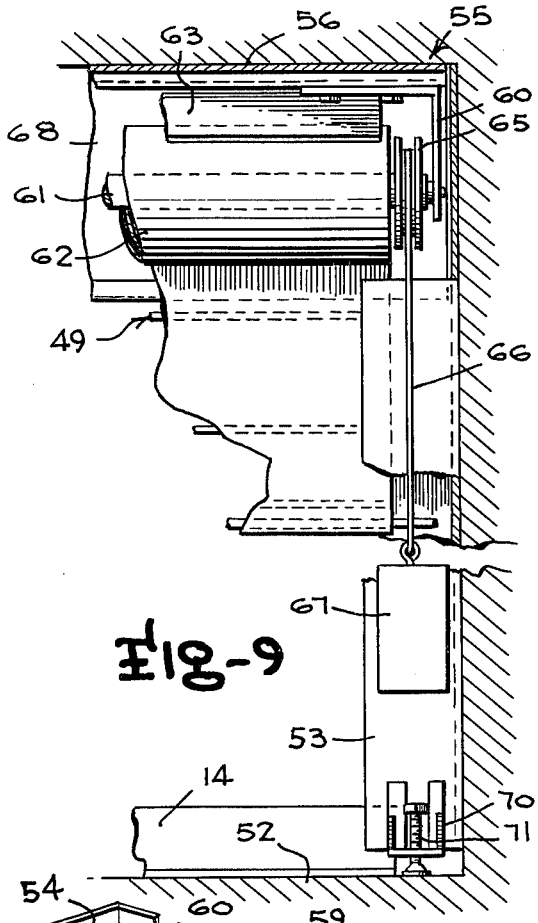
FIG. 9 is a sectional view taken on the line 9—9 of FIG. 8.
Figure 8:
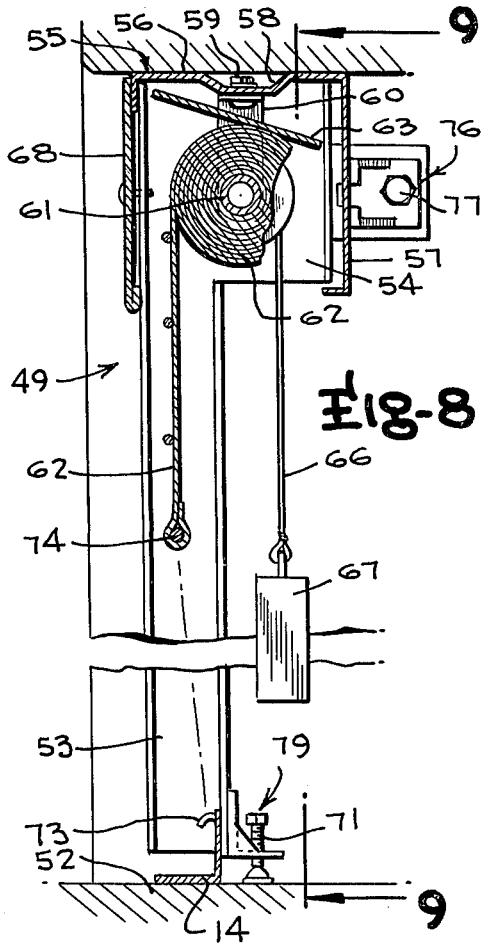
FIG. 8 is a sectional view taken on the line 8—8 of FIG. 7.

A rod 61 has an asbestos cloth curtain 62 rolled thereon. The curtain 62 has reinforcing rods 17 thereon similar to the reinforcing rods shown in the first described version of the present invention. A hinged flap 63 is mounted above the asbestos roll 62 and the flap 63 may be hingedly supported by means of clips 64. The flap 63 is important because it closes off the opening above the roller. Wire takeup spools 65 are mounted on the ends of the rod 61, and wires 66 are arranged in engagement with the spools 65 and the wires 66 have counterweights 67 connected thereto, as shown in FIGS. 8, 9 and 10.

Figure 7:
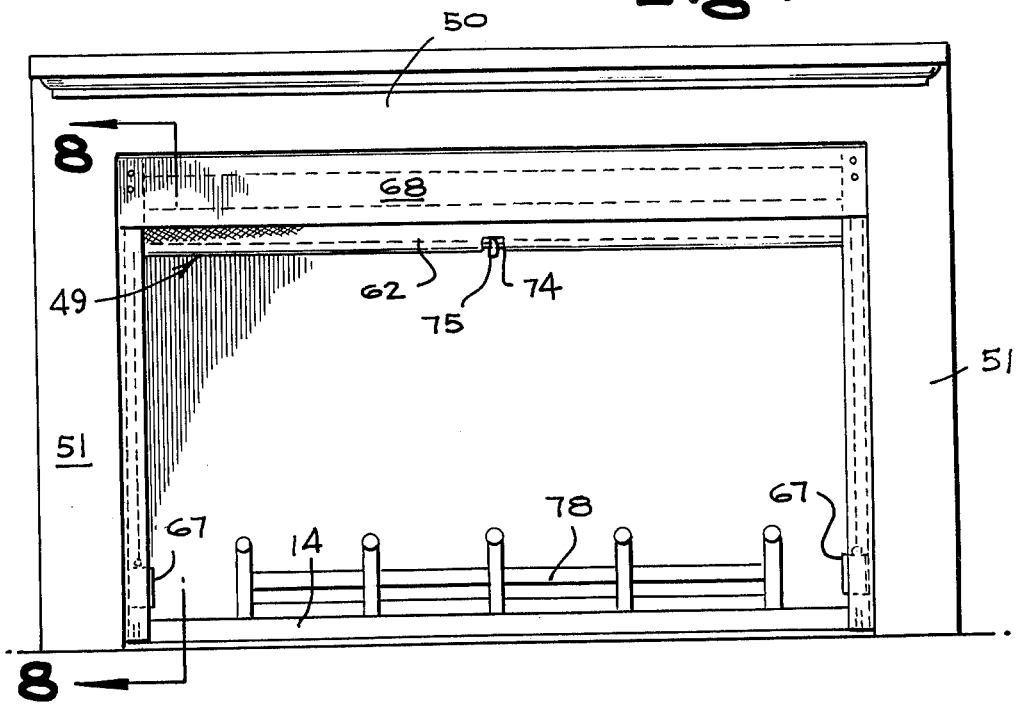
FIG. 7 is a front elevational view of a modified form of the present invention.

A face panel or plate 68 is adapted to be secured in place by means of securing elements 69. The numeral 70 indicates lower compression fittings for anchoring the unit vertically, and the fittings 70 include screw members 71 that are adapted to have fasteners 72 arranged in engagement therewith. The fittings 70 are provided with hook portions 73 for selective engagement with the projecting ends of a rod 74 that is mounted on the lower or free end of the asbestos curtain 62. The numeral 75 indicates a finger engaging portion that is adapted to be used for facilitating the manual movement of the curtain or shield 62. The numeral 76 indicates upper compression fittings that anchor the unit horizontally, FIG. 10, and the upper fittings 76 include adjustable screw members 77. As shown in FIG. 7, a grate of conventional construction can be provided for the fireplace.

From the foregoing, it will be seen that there has been provided a fireplace screen or shield, and in use with the parts arranged as shown in FIGS. 1 through 6, for example, it will be seen that when the parts are in the position of FIG. 1, the asbestos curtain or shield 45 is in closed position so that various advantages are provided as, for example, heat loss from the room in which the fireplace is located will be prevented. FIG. 2 also illustrates the shield in closed position. When it is desired to open or raise the screen 45, it is only necessary to manually grip the portion or member 43 with the fingers as shown in FIG. 5 and pull downwardly on the member 43 whereby the chains 42 that extend over the rollers 40 will raise the screen 45 to an open position as shown in FIG. 5, and the hook 43 can be arranged in engagement with a member such as the lug 44 whereby the screen 45 can be maintained in its raised or open position.

When using the device shown in FIGS. 7 through 10, the device can be mounted in a conventional fireplace as shown in the drawings and when it is desired to move the screen 62, it is only necessary to grip a portion such as the portion 75 whereby the roll of material 62 on the rod 61 can be adjusted to the desired position. Hooks such as the hooks 73 are adapted to receive the projecting portions 74 of the rod in the lower end of the screen 62, whereby the screen can be conveniently maintained in its closed position.

The parts can be made of any suitable material and in different shapes or sizes as desired or required.

With further reference to the construction shown in FIGS. 1 through 6, the numeral 37 indicates the upper compression fittings, and there is provided the side angles 27 as well as the top angle 32 and the shield support angle 33. The bead chains 42 are connected to the asbestos fiber 45, and the steel reinforcing rods 46 are suitably affixed to the asbestos fiber 45. There is further provided the lower compression fittings 28 as well as the bottom angle 34. The parts 27, 32 and 34 form a rigid frame inside the fireplace. The part 33 with the asbestos member 45 already attached is added to the frame. The frame plate 35 is then added to complete the installation so that in FIGS. 1 through 6 there is provided a folding fireplace shield.

The primary function of the shield is as an energy saver, to minimize the draft or air flow at the fireplace opening once the fire has died down, since the flu must remain open while the embers are dying. This permits the effective use of the fireplace to heat the residence without encountering excessive heat loss, and additional burden on the residence furnace, as is presently experienced as room heat is drawn up the chimney.

The present invention provides universal mounting capability and the homeowner or installer meeds only a hacksaw, scissors, drill and screwdriver. Further, the present invention is such that the homeowner or installer needs no complicated tools, and the manufacturer can make standard sizes to fit all types of constructions. There are no holes required in the fireplace masonry, as the unique design of the frame allows the user to custom cut the frame to fit, and then using the compression fittings provided achieve a secure installation. The fabric of the shield is a special tightly woven asbestos fiber material or the like designed to resist open flame and very high temperatures. Once mounted, in the present construction, the fabric shield when pulled into position is guided inside the vertical side frames, as shown in FIGS. 7 through 10, which support the fabric so that it will not be drawn inward, and this minimizes the air space opening at the side walls. Another feature of the design of FIGS. 7 through 10 is the hinged flap 63 along the top of the fabric roll 62, and the flap 63 falls by gravity and serves to close off the air gap which results as the fabric is pulled down into place.

The construction of FIGS. 7 through 10 utilizes a simple counterbalance principle and works efficiently. It is necessary by virtue of the application to keep the mechanics straight forward, as the high temperatures can result in continuous expansion and contraction of materials. The economics of design and manufacture are paramount, and the product has a construction so that it is not expensive to manufacture or sell.

The construction such as that shown in FIGS. 1 through 6 features a universal mounting frame wherein the simple frame including parts such as the parts 27, 32 and 34 are first installed, and then the mechanical components such as the parts 33 and 45 are attached thereto as by means of wing nuts and the like, and this subassembly helps to simplify installation and minimizes human error.

Asbestos fabric 45 is used in FIGS. 1 through 6 and similarly, asbestos material 62 is used in FIGS. 7 through 10.

With the folding action of FIGS. 1 through 6, it is possible to secure the fabric firmly at the top to seal off any air flow. When the screen drops down, it lays flat against the side and bottom frames effectively cutting off any air flow into the fireplace and up the chimney. The steel reinforcing rods 46 stop the fabric from being sucked in by the draft, which is considerable, and also serve as guides for the bead chain which produces the folding action. The important point of the fireplace shield is to seal off the air flow.

Considering further the construction of FIGS. 7 through 10, the metal case 55 and screen can be cut to the desired width. The hinged flap 63 closes the gap as the roll 52 unwinds. The upper compression fittings 76 anchor the unit horizontally. The numeral 65 indicates wire takeup spools. The vertical members 53 can be cut off at the desired height. The lower compression fittings 70 anchor the unit vertically. The face panel 68 is removable from the front of the fireplace for ease of access. The cloth asbestos fiber such as the fiber member 62 is flame resistant. The counterweights 67 on each side wind up the screen, so that in FIGS. 7 through 10 there is provided an adjustable fireplace screen.

The device can be made to fit fireplaces or hearths of different sizes or shapes.

With further reference to the device shown in FIGS. 7 through 10, after cutting the vertical side pieces to the proper length, the lower compression fittings 70 are slipped into place, and the side frames are secured in position by turning out the threaded bolts 71 until adequate holding pressure is achieved. Similarly, after cutting the horizontal top frame to the proper length, the upper compression fittings 76 are slipped into place, and the top frame is secured in position by turning out the threaded bolts 77 until adequate holding pressure is provided. The final installation step for the device of FIGS. 7 through 10 is to cut the face panel to length, drill one hole at each end through the face panel and side frame, then secure the face panel with sheet metal screws or the like. The face panel can be readily removed from the front of the fireplace for ease of access to the roll mechanism.

In the arrangement shown in FIGS. 1 through 6, the screen folds up in accordion-like fashion. In FIGS. 7 through 10, a rolling action is provided for the asbestos screen.

Referring now to FIGS. 11, 12 and 13 of the drawings, there is illustrated a modified or alternative form of the invention which is in the form of a portable folding fire shield, as indicated generally by the numeral 85, and the unit 85 comprises a frame 86 that includes sides 87 that consist of similar sections 88 that are hingedly connected together as at 89. The frame 86 further includes a top and bottom section 90 and 91, as well as an asbestos fabric shield 92. The portable folding fire shield 85 of FIGS. 11 through 13 further includes handles 93 that have handle pins 94 connected thereto. Magnets 95 are secured to face bricks of the fireplace 97 by means of a fastener, epoxy adhesive or the like. Openings 96 are provided in the side portions of the frame for selectively receiving the latch pins or handle pins 94, as shown in FIG. 12, when the device is to be maintained in a certain position such as its open or extended position. Pivot hinges 99 are arranged as shown at the corners of the frame so as to permit the parts to move from a position such as that shown in FIG. 11 to a position such as that shown in FIG. 13. In FIG. 13, the numeral 100 indicates a handy or convenient heavy-duty storage tube for supporting the device when the device is in folded position and when the device or unit is not being used.

Thus, as shown in FIGS. 11, 12 and 13, there is illustrated a portable folding fire shield wherein the unit folds for storage as illustrated in FIG. 13, when the unit is not being used. In FIG. 11, the deep frame 86 is provided to fit over the front mounted mesh screens which may be on some existing fireplaces. The unit is maintained in the open position by engaging the handle pins 94 in the openings 96 in the frame, or by utilizing a secondary mechanical latch. Thus, the portable folding fire shield 85 FIGS. 11 through 13 embodies the same performance features, namely, sealing the fireplace opening and acting as a fireproof curtain, resisting air pressure differentials.

With further reference to the folding unit shown in FIGS. 11, 12 and 13, the unit can be mounted in place by magnets that can be connected to a wall, or suitable folding legs can be used to stabilize the unit in a manner similar to supports that are used for easles or the like, so that basically a means is provided for supporting the device against a wall and such a support means may include small legs and the like.

The unit 85 consists of a thick frame 86 that has a piece of asbestos material 92 that may be suitably affixed to the frame, and magents such as the magnets 95 serve to selectively hold the unit against the wall whereby the fireplace can be blocked off in the desired manner.

In FIG. 10, the numeral 14 indicates an angle that is adapted to be arranged in the lower portion of that particular construction.

In summary, the present invention possesses certain important advantages or features, the essence thereof being that it seals the fireplace opening, acts as a fireproof curtain, and resists air pressure differential forces. These results are accomplished by mounting a frame in the fireplace opening by compression fittings and providing a fire resistant shield which can be lowered within the frame in order to completely occlude the fireplace opening. The invention relates to an adjustable fireplace screen or shield the primary function of which is, as an energy saver, that it minimizes the loss of warm air from a room after the fire has died down. This is the time when the fire no longer heats the room and the flu must remain open. The present invention permits the effective use of the fireplace to heat the residence without encountering excessive heat loss and additional burden on the residence furnace as is presently experienced as room heat is drawn up the chimney. The secondary function of the shield is as a safety device for home and commercial businesses such as restaurants, ski lodges, clubs, etc. where the shield can be used to control a runaway fire or to prevent downdrafts from blowing glowing embers out into a room.

Additional embodiments of the invention in this apecification will occur to others and, therefore, it is intended that the scope of the invention be limited only by the appended claims and not by the embodiments described hereinabove. Accordingly, reference should be made to the following claims in determining the full scope of the invention.

What is claimed is:

1. Apparatus for use in a fireplace of the type that includes side walls, a base portion and a top wall, comprising a frame located within the opening of the fireplace and including a pair of spaced parallel vertically disposed side angles mounted adjacent to said side walls, lower adjustable screw threaded compression fittings connected to the lower ends of said side angles, a horizontally disposed top angle positioned adjacent to said top wall and extending between the upper ends of said side angles and secured thereto, a horizontally disposed support angle mounted below said top angle and proximate thereto, a horizontally disposed bottom angle extending between the lower ends of said side angles and secured thereto, upper adjustable screw threaded compression fittings connected to the ends of said top angle, a plurality of rollers connected to said support angle, chains trained over said rollers, a finger-engaging piece connected to said chains, a keeper connected to the lower portion of one of said angles for selective engagement by said finger piece, a foldable fire resistant screen which substantially prevents the flow of air therethrough connected to said support angle, said screen having a plurality of horizontally disposed reinforcing rods connected thereto, said screen and said reinforcing rods overlying said side angles and said bottom angle to substantially close the fireplace opening, guide members connected to said rods and having said chains extended therethrough, and the lower ends of said chains being secured to the lower portions of said screen.

2. The structure as defined in claim 1, and further including a horizontally disposed face plate secured between the top portions of said side angles.

3. A fireplace shield for use in a fireplace having a pair of side walls, a top wall and a base portion, said shield comprising a frame located within the opening of the fireplace, said frame including a pair of spaced generally parallel vertically disposed side members located adjacent to said side walls and a pair of generally parallel top and bottom members extending horizontally between and fixed to opposite ends of said side members adjacent to said top wall and said base portion respectively of the fireplace, a pair of lower adjustable screw threaded compression fittings mounted on said side members for moving said frame upwardly so that said top member frictionally engages the top wall of the fireplace, a pair of upper adjustable screw threaded compression fittings mounted on said side members for frictionally engaging the side walls of the fireplace, a shield support carried by said top member, a flexible fire resistant screen which substantially prevents the flow of air therethrough connected to said top member by said shield support, a plurality of horizontally disposed reinforcing rods fixed to said screen in vertically spaced relationship with each other, said screen and said reinforcing rods overlying said side members and said bottom member of said frame to substantially close the fireplace opening when said screen is in lowered operative position, and means for raising said screen and rods to an upper inoperative position.

* * * * *